US011105110B2

(12) United States Patent
Watson et al.

(10) Patent No.: US 11,105,110 B2
(45) Date of Patent: Aug. 31, 2021

(54) CLOSED SHEAR WALL HOLD DOWN SYSTEM

(71) Applicant: Katerra Inc., Menlo Park, CA (US)

(72) Inventors: Will Watson, Seattle, WA (US); Gary Fong, Cupertino, CA (US)

(73) Assignee: Katerra Inc., Menlo Park, CA (US)

( * ) Notice: Subject to any disclaimer, the term of this patent is extended or adjusted under 35 U.S.C. 154(b) by 0 days.

(21) Appl. No.: 16/723,530

(22) Filed: Dec. 20, 2019

(65) Prior Publication Data

US 2020/0208419 A1 Jul. 2, 2020

Related U.S. Application Data

(60) Provisional application No. 62/786,868, filed on Dec. 31, 2018.

(51) Int. Cl.

| | |
|---|---|
| ***E04H 9/02*** | (2006.01) |
| ***E04B 1/38*** | (2006.01) |
| ***E04G 17/065*** | (2006.01) |
| ***E04B 2/02*** | (2006.01) |
| ***E04B 2/00*** | (2006.01) |

(52) U.S. Cl.

CPC ..... *E04H 9/021* (2013.01); *E04B 1/38* (2013.01); *E04B 2/02* (2013.01); *E04C 2/46* (2013.01); *E04C 2/48* (2013.01); *E04G 17/0657* (2013.01); *E04B 2002/0254* (2013.01)

(58) Field of Classification Search

CPC ..... E04B 1/38; E04C 2/44; E04C 2/46; E04C 2/48; E04C 2/526; E04H 9/02; E04H 9/021; E04H 9/027

USPC ..... 52/293.3, 274, 285.1, 285.2, 264, 236.7, 52/236.9, 745.09, 745.1

See application file for complete search history.

(56) References Cited

U.S. PATENT DOCUMENTS 3,158,045 A * 11/1964 Siler ..... B23B 49/02 408/1 R
3,238,732 A * 3/1966 Aas-Jakobsen ..... E02D 5/523 405/252
4,111,401 A * 9/1978 Pickett ..... E01F 8/0017 256/13.1
5,317,850 A * 6/1994 Colonias ..... E04B 1/0007 52/293.3
5,364,214 A * 11/1994 Fazekas ..... E04H 9/02 411/354

(Continued)

FOREIGN PATENT DOCUMENTS

CN 209179497 U * 7/2019 ..... E04G 17/065

*Primary Examiner* — Michael Safavi
(74) *Attorney, Agent, or Firm* — Volpe Koenig

(57) ABSTRACT

A closed wall hold down system is provided including at least one closed wall panel, at least one first tie rod, at least one second tie rod, at least one coupler nut, and at least one ratcheting take-up device. The at least one closed wall panel includes a bottom plate and a top plate. The at least one first tie rod projects through the bottom plate. The at least one coupler nut is coupled to the at least one first tie rod and to a first end of the at least one second tie rod. A second end of the at least one second tie rod extends through the top plate. The at least one ratcheting take-up device engages the second end of the at least one second tie rod. A method of installing the closed wall hold down system is also provided.

21 Claims, 10 Drawing Sheets

(56) References Cited

U.S. PATENT DOCUMENTS

| | | | | |
|---|---|---|---|---|
| 6,609,867 | B2 * | 8/2003 | Wakabayashi | F16B 39/128<br>411/14 |
| 7,150,132 | B2 * | 12/2006 | Commins | E04B 1/26<br>52/293.3 |
| 7,971,411 | B2 * | 7/2011 | Commins | E04H 9/14<br>52/745.21 |
| 8,276,333 | B2 * | 10/2012 | Bransford | B25B 13/48<br>52/223.13 |
| 9,091,059 | B2 * | 7/2015 | Wrightman | F16B 39/28 |
| 9,097,001 | B2 * | 8/2015 | Espinosa | E04B 1/4157 |
| 9,388,841 | B2 * | 7/2016 | Allmon | F16B 35/04 |
| 10,036,158 | B2 * | 7/2018 | Espinosa | E04C 5/16 |
| 10,605,284 | B2 * | 3/2020 | Taneichi | E04B 1/2604 |
| 2001/0002524 | A1 * | 6/2001 | Espinosa | E04H 9/02<br>52/293.3 |
| 2003/0167711 | A1 * | 9/2003 | Lstiburek | E04B 1/26<br>52/223.4 |
| 2007/0056235 | A1 * | 3/2007 | Kohler | E04C 2/041<br>52/223.7 |
| 2011/0113711 | A1 * | 5/2011 | Espinosa | E04B 1/4157<br>52/293.1 |
| 2013/0340366 | A1 * | 12/2013 | Gray | E04B 1/26<br>52/223.14 |
| 2014/0260067 | A1 * | 9/2014 | Pryor | E04B 1/26<br>52/704 |

* cited by examiner

CLOSED SHEAR WALL HOLD DOWN SYSTEM

CROSS REFERENCE TO RELATED APPLICATION

This application claims the benefit of U.S. Provisional Application No. 62/786,868 filed on Dec. 31, 2018 for CLOSED WALL HOLD DOWNS, which is incorporated by reference as if fully set forth.

FIELD OF INVENTION

The present invention relates generally to the art of walls of buildings, and more specifically to a system that holds down a shear wall to the foundation and the method of installation thereof.

BACKGROUND

In a traditionally built exterior building wall, the structural frame of the wall is bolted or screwed to the foundation or floor during construction. Anchor bolts fixed to the foundation secure the wall forms and other construction portions to the concrete slab foundation. Most commonly, anchor bolts are cast-in-place in preset positions, wherein the bolt head is cast into the concrete and the threaded end extends out of the foundation. The structural frame of the wall is then constructed by securing the bottom plate to the foundation. The bottom plate is secured by predrilling holes into the bottom plate. The size and placement of the holes correspond with the position of the anchor bolts. The bottom plate is placed flat on the concrete foundation with the threaded ends of the anchor bolts extending up through the holes of the bottom plate. The nut of the anchor bolt is screwed onto the bolt threads to secure the bottom plate. The rest of the exterior wall components are then installed.

A second floor, third floor, etc. wall is secured to the floor plate. Typically, the structural frame of the wall is constructed by nailing or screwing the bottom plate of the wall to the floor plate. The other components of the structural frame of the wall are then installed.

However, some walls systems are constructed from prefabricate wall panels. A wall panel may be assembled with the structural frame attached to the wall's interior and exterior components. In this case, after the prefabricated wall panel is placed onto the threaded ends of the anchor bolts or onto the floor plate, the anchor bolts are no longer accessible to screw the nut onto the anchor bolt threads and the bottom plate is no longer accessible to nail or screw to the floor plate. Because the threads of the anchor bolts or the bottom plate are no longer accessible, there is no way to secure the prefabricated wall panel to the foundation or floor plate.

SUMMARY

A closed wall hold down system that secures prefabricated wall panels to a foundation and/or floor panel is provided. The closed wall hold down system includes at least one closed wall panel, at least one first tie rod, at least one second tie rod, at least one coupler nut, and at least one ratcheting take-up device. The at least one closed wall panel includes a bottom plate and a top plate. The at least one first tie rod is configured to project through the bottom plate within the at least one closed wall panel. The at least one coupler nut is configured to couple the at least one first tie rod and a first end of an at least one second tie rod. A second end of the at least one second tie rod is configured to extend through the top plate. The at least one ratcheting take-up device is configured to engage with the second end of the at least one second tie rod.

A method of installing a closed wall hold down system is also provided. The method includes installing a closed wall panel. The closed wall panel includes a bottom plate and a top plate. The closed wall panel is installed over at least one first tie rod. The at least one first tie rod projects through the bottom plate. The method includes running at least one second tie rod down through the top plate. The at least one second tie rod includes a first end, a second end, and a coupler nut coupled to the first end. The second end extends through the top plate. The method includes threading the coupler nut onto the at least one first tie rod and installing at least one ratcheting take-up device onto the second end.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise closed wall hold down system shown.

DETAILED DESCRIPTION

A closed wall hold down system is provided that quickly and efficiently connects closed wall panels of multiple floors. The closed wall hold down system may be installed without accessing the internal components of a wall panel. A prefabricated wall panel may be installed with this system. Because the wall panel can be assembled prior to arriving at the job site, the time it takes to construct a wall is reduced thereby cutting construction costs.

The closed wall hold down system includes at least one closed wall panel, at least one first tie rod, at least one second tie rod, at least one coupler nut, and at least one ratcheting take-up device. The at least one closed wall panel includes a bottom plate and a top plate. The at least one first tie rod is configured to project through the bottom plate within the at least one closed wall panel. The at least one coupler nut is configured to couple the at least one first tie rod and a first end of an at least one second tie rod. A second end of the at least one second tie rod is configured to extend through the top plate. The at least one ratcheting take-up device is configured to engage with the second end of the at least one second tie rod.

A method of installing a closed wall hold down system is also provided. The method includes installing a closed wall panel. The closed wall panel includes a bottom plate and a top plate. The closed wall panel is installed over at least one first tie rod. The at least one first tie rod projects through the bottom plate. The method includes running at least one second tie rod down through the top plate. The at least one second tie rod includes a first end, a second end, and a coupler nut coupled to the first end. The second end extends through the top plate. The method includes threading the coupler nut onto the at least one first tie rod and installing at least one ratcheting take-up device onto the second end. The method may be repeated for a multi-story building.

Figure 1:
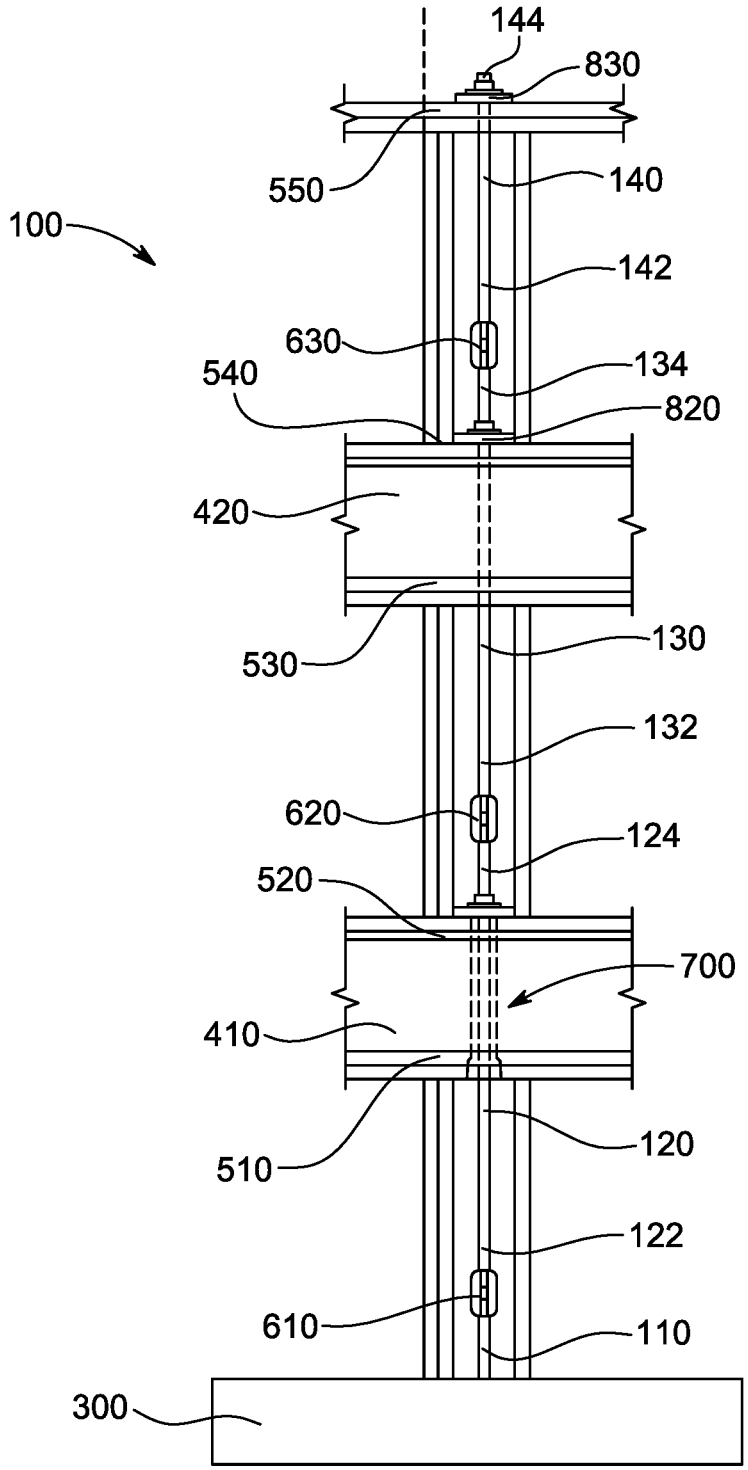
FIG. 1 is a front view of a closed wall hold down system.

FIG. 1 is a front view of a closed wall hold down system 100. The closed wall hold down system 100 holds down and connects closed wall panels (not shown in FIG. 1 for clarity) of adjoining floors. FIG. 1 shows an embodiment of a hold down system 100 for three wall panels of three adjoining floors. Although FIG. 1 shows an embodiment with three wall panels of three adjoining floors, the closed wall hold down system 100 may be used to hold down and connect two or more adjoining floors. Each closed wall panel may include a bottom plate 520, 540 and a top plate 510, 530, 550. The closed wall hold down system 100 also includes at least one floor plate 410, 420. The floor plates 410, 420 separate the closed wall panels of different floors and are a component of the building's floor and/or ceiling. The closed wall hold down system 100 holds down the closed wall panels and is designed to handle and transfer shear loads applied to the wall.

The closed wall hold down system 100 includes at least one tie rod 110, 120, 130, 140. As shown in FIG. 1, the first tie rod 110 may be embedded in the foundation 300. The second 120, third 130, and fourth 140 tie rods each have a first end 122, 132, 142 connected to a coupler nut 610, 620, 630. The second 120, third 130, and fourth 140 tie rods each have a second end 124, 134, 144. The second ends 124, 134 of the second 120 and third 130 tie rods connect to the coupler nut 620, 630 of the next tie rod. The second 120, third 130, and fourth 140 tie rods each extend through the top plate 510, 530, 550 of the first, second, and third closed wall panels respectively. The second 120 and third 130 tie rods also extend through the floor plates 410, 420 and the bottom plates 520, 540 of the second and third closed wall panels. The bottom plates 520, 540, the top plates 510, 530, 550, and the floor plates 410, 420 may include a funnel and pipe 700 to facilitate the tie rods 120, 130, 140 extending there through. The closed wall hold down system 100 shown in FIG. 1 includes four tie rods 110, 120, 130, 140. However, the system 100 may include more or less tie rods 110, 120, 130, 140 depending on the number of floors desired. The tie rods 110, 120, 130, 140 may be made from a material that is strong in tension and shear, such as metal, to handle applied loads. The tie rods 110, 120, 130, 140 may be made from steel or aluminum. The tie rods 110, 120, 130, 140 may include threads to engage with threads on the inner circumference of the coupler nuts 610, 620, 630.

The closed wall hold down system 100 also includes at least one coupler nut 610, 620, 630. The coupler nuts 610, 620, 630 couple the tie rods 110, 120, 130, 140 together. While FIG. 1 shows three coupler nuts 610, 620, 630, the number of coupler nuts 610, 620, 630 may be more or less depending on the number of tie rods 110, 120, 130, 140. The coupler nuts 610, 620, 630 may include threads in the inner circumference to enable the coupler nut 610, 620, 630 to engage with threads on the ends of the tie rods 110, 120, 130, 140. The coupler nut 610, 620, 630 may be made out of a material that is at least as strong as the tie rods 110, 120, 130, 140. The coupler nut 610, 620, 630 may be made out of a metal, for example steel or aluminum.

As shown in FIG. 1, the closed wall hold down system 100 also includes at least one ratcheting take-up device 810, 820, 830. The at least one ratcheting take-up device 810, 820, 830 secures the tie rods 110, 120, 130, 140 in tension. Because the tie rods 110, 120, 130, 140 are in tension, the closed wall system 100 is held down. The ratcheting take-up device 810, 820, 830 includes an opening through the device. The end of the tie rod 110, 120, 130, 140 enters the opening and extends through the device 810, 820, 830. As the tie rod enters the device 810, 820, 830, a series of internal threaded wedges allow the device 810, 820, 830 to ratchet the tie rod 110, 120, 130, 140 up through the device 810, 820, 830. The threaded wedges engage with the threads of the tie rod 110, 120, 130, 140 in the reverse direction when the rod 110, 120, 130, 140 is under tension. The ratcheting take-up device 810, 820, 830 may be connected to the top surface of the bottom plate 520, 530 or the top surface of the top plate 510, 530, 550. The opening in the bottom plate 520, 530, 550 and/or top plate aligns with the opening of the ratcheting take-up device 810, 820, 830 to allow the tie rods 110, 120, 130, 140 to extend there through.

FIGS. 2-9 show the process of installing the closed wall hold down system 100 of FIG. 1. FIGS. 2-9 show a wall system installed with two closed wall hold down systems 100. Although the wall system is held down with two closed wall hold down systems 100, the wall may include more than two closed wall hold down systems 100. Although FIGS. 2-9 show the process of installing the closed wall system 100 of three adjoining floors. A substantially similar process may be used to install a closed wall system 100 of two adjoining floors or more than three adjoining floors.

Figure 2:
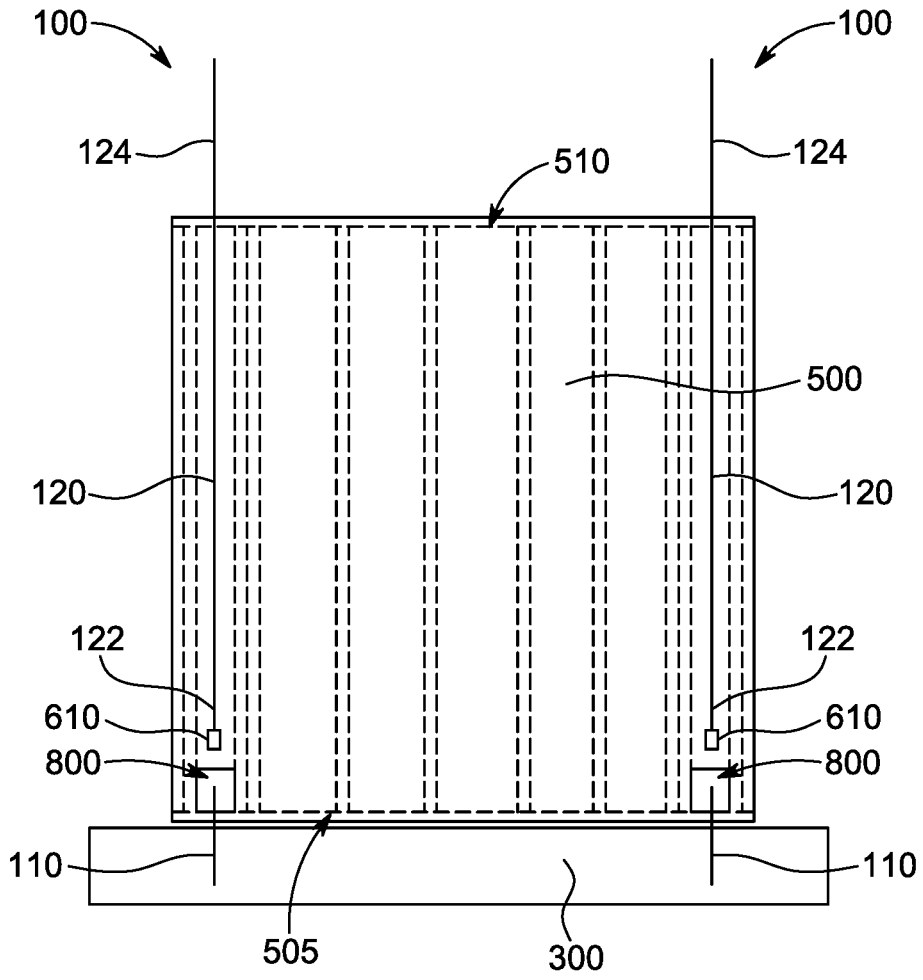
FIG. 2 is a front view of a first closed wall panel being installed.

FIG. 2 is a front view of a first closed wall panel 500 being installed. FIG. 2 shows a first closed wall panel 500 and two closed wall hold down systems 100. The first closed wall panel 500 is installed to the foundation 300. As shown in FIG. 2, the first tie rod 110 is embedded in the foundation 300. The first tie rod 110 extends through the bottom plate 505 of the first closed wall panel 500. A second tie rod 120 runs down through an opening in the top plate 510 of the first closed wall panel 500. A coupler nut 610 is attached to the first end 122 of the second tie rod 120. The coupler nut 610 may be attached to the first end 122 by any means such as welding or engaged threads. The second end 124 of the second tie rod 120 extends up through the top plate 510.

Figure 3:
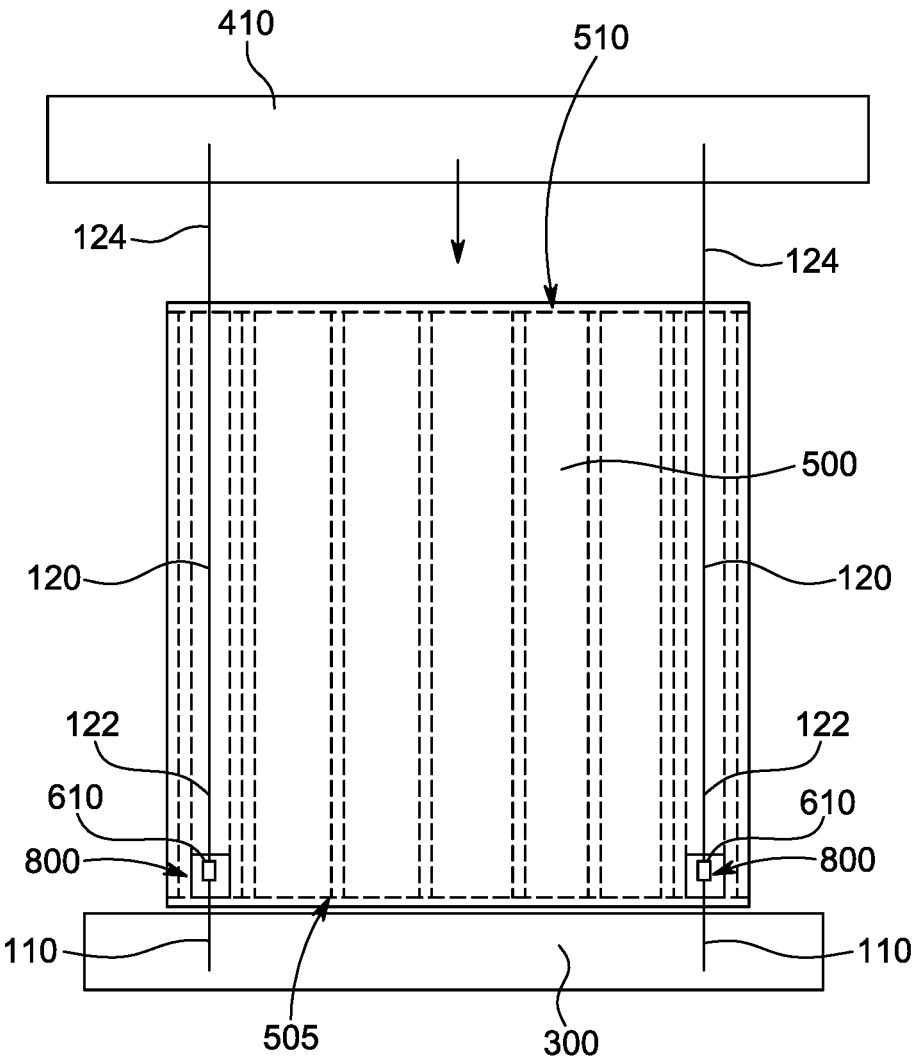
FIG. 3 is a front view of a first floor plate being installed.

FIG. 3 is a front view of a first floor plate 410 being installed. As shown in FIG. 3, the coupler nut 610 attached to the first end 122 of the second tie rod 120 is coupled to the first tie rod 110. The coupler nut 610 may be attached to the first tie rod 110 by any means of attachment such as screwing the threaded coupler nut 610 onto the first tie rod 110. The closed wall panel 500 may include block outs or openings 800 in the drywall to allow for inspection of the coupler nut 610 and tie rod 110, 120 connections. Alternatively, the closed wall panel 500 may not include block outs 800, and instead, the connections may be inspected with x-ray florescence. The coupler nut 610 may be marked such that the degrees of rotation may be captured as the nut is tightened. The markings may be physical to allow monitoring and inspection through the block out 800, or if there are no block outs 800, the markings may be photo-emissive to allow monitoring and inspection through the drywall. As shown in FIG. 3, the second end 124 of the second tie rod 120 extends through the top plate 510 of the closed wall panel 500. The floor plate 410 includes openings through the floor plate 410 at the location of the tie rods 120 to let the tie rod 120 extend there through. These openings may be predrilled. The first floor plate 410 slides down over the second end 124 of the second tie rod 120 with the tie rod extending 120 up through the openings in the floor plate 410. The floor plate 410 may then be secured to the top plate 510.

Figure 4:
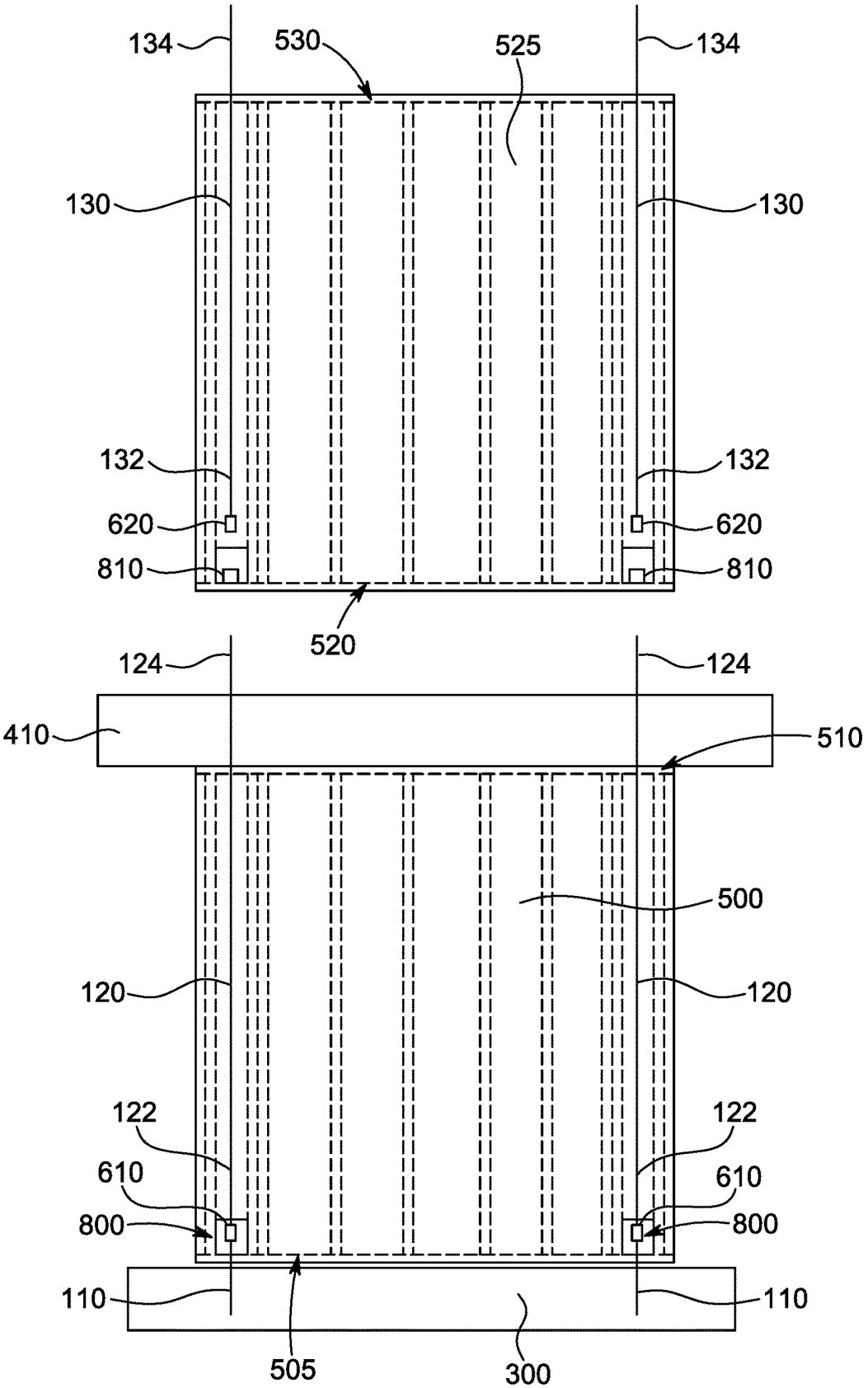
FIG. 4 is a front view of a second closed wall panel being installed.

FIG. 4 is a front view of a second closed wall panel 525 being installed. The second closed wall panel 525 includes at least one ratcheting take-up device 810 attached to the top of the bottom plate 520. A third tie rod 130 runs down through an opening in the top plate 530 of the second closed wall panel 525. FIG. 4 also shows the second coupler nut 620 attached to the first end 132 of the third tie rod 130. The second coupler nut 620 may be attached to the first end 132 by any means such as welding or engaged threads. The second end 134 of the third tie rod 130 extends through the top plate 530.

Figure 5:
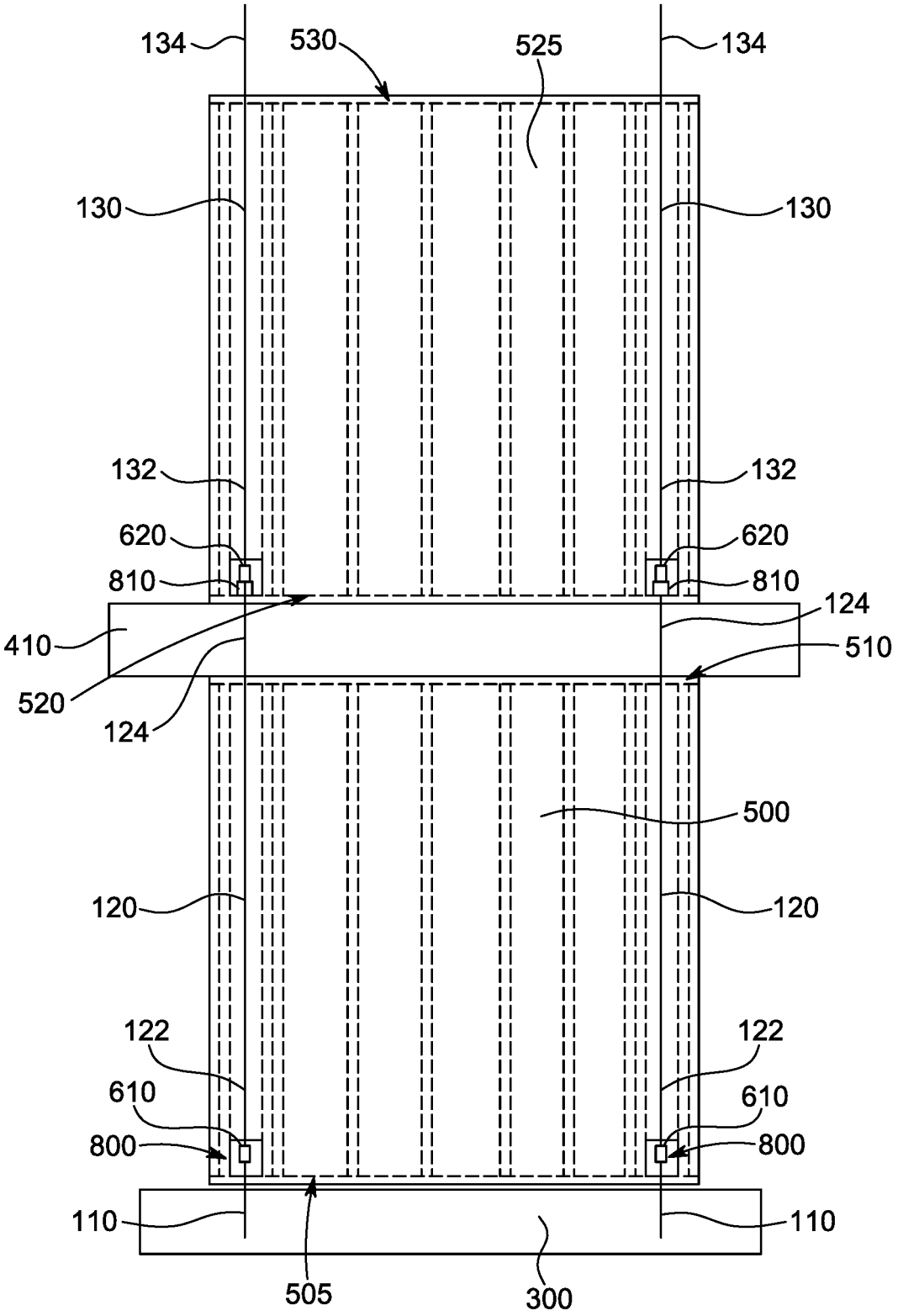
FIG. 5 is a front view of the second closed wall panel installed.

FIG. 5 is a front view of the second closed wall panel 525 installed. As shown in FIG. 5, the second end 124 of the second tie rod 120 extends up through the bottom plate 520 of the second closed wall panel 525 and through the ratcheting take-up device 810. The ratcheting take-up device 810 secures the second tie rod 120 in tension, thereby holding down the first floor plate 410 and first closed wall panel 500. The second coupler nut 620 attaches to the second end 124 of the second tie rod 120. The second coupler nut 620 may be attached to the second tie rod 120 by any means of attachment such as screwing the threaded coupler nut 620 onto the second tie rod 120. The second end 134 of the third tie rod 130 extends up through the top plate 530 of the second closed wall panel 525. If a two floor structure is desired, a ratcheting take-up device (not shown) may be installed on the top plate 530 of the second closed wall panel 525 with the second end 134 of the third tie rod 130 extending through the ratcheting take-up device. The ratcheting take-up device would secure and hold down the closed wall panels 500, 525 of the first and second floors. However, if more than two floors are desired, a third floor may be installed according to FIGS. 6-9.

Figure 6:
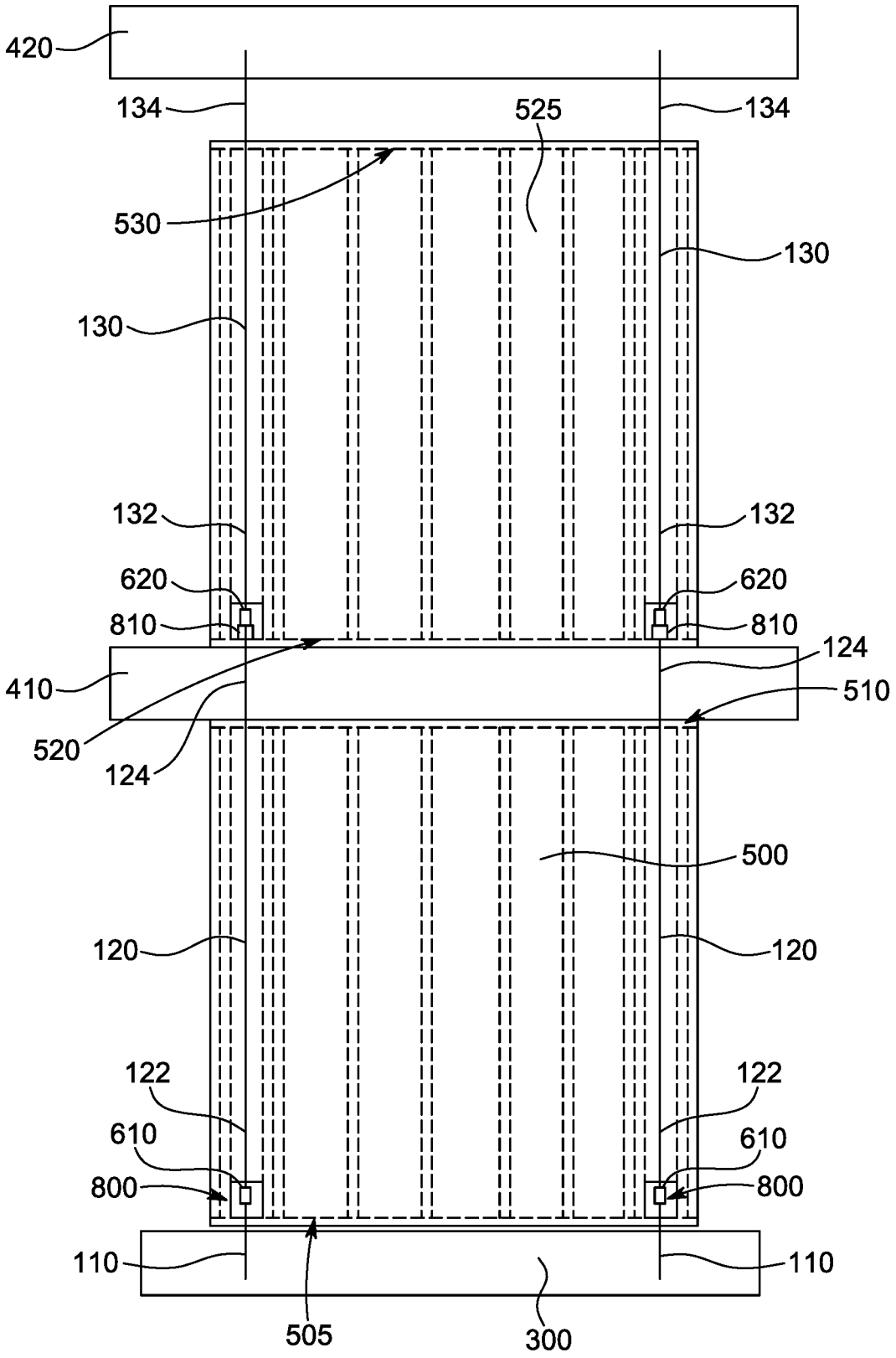
FIG. 6 is a front view of a second floor plate being installed.

FIG. 6 is a front view of a second floor plate 420 being installed. The second floor plate 420 slides down over the second end 134 of the third tie rod 130 and may be secured to the top plate 530. The second floor plate 420 may include predrilled openings through the floor plate 420 at the locations of the third tie rods 130. The third tie rod 130 extends up through the openings in the floor plate 420.

Figure 7:
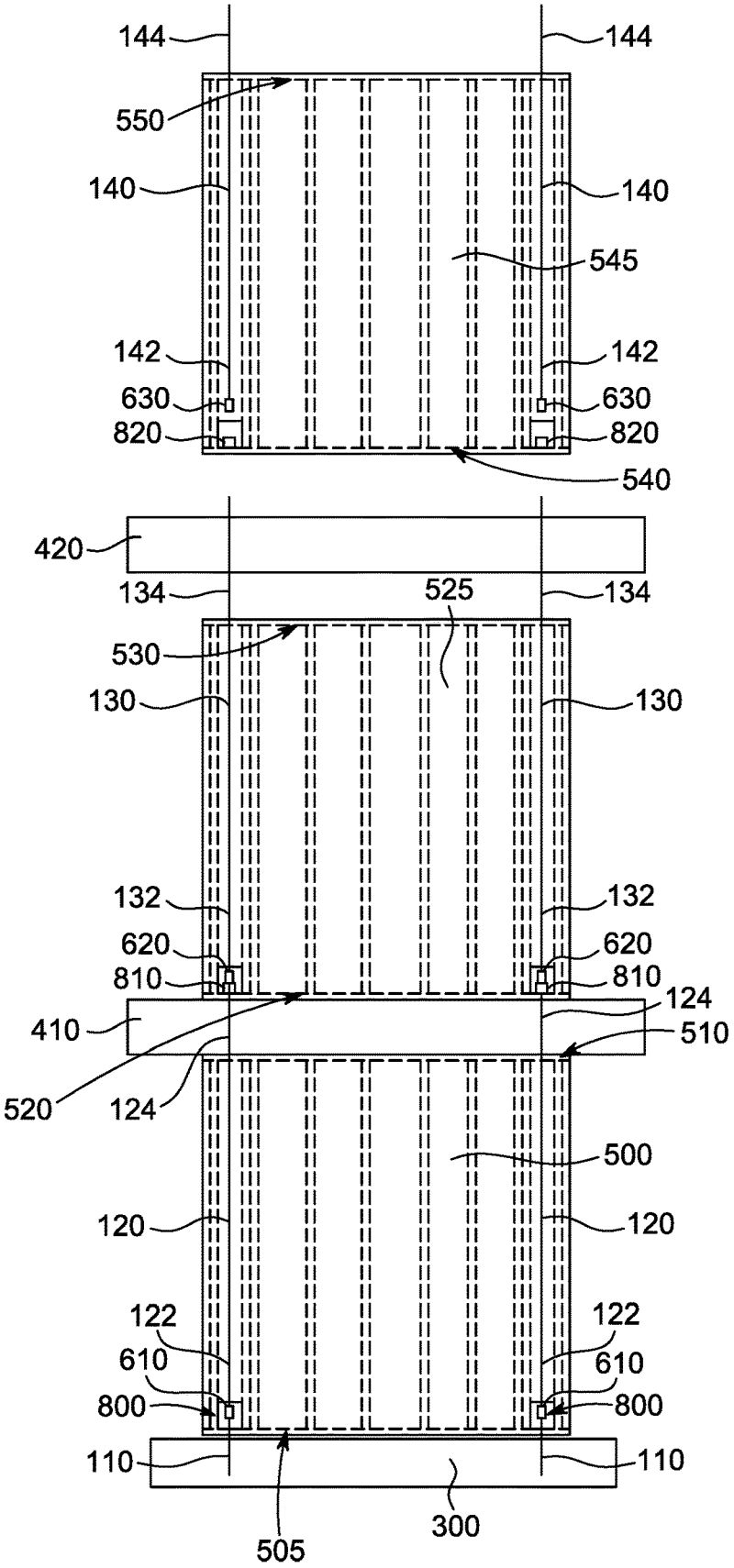
FIG. 7 is a front view of a third closed wall panel being installed.

FIG. 7 is a front view of a third closed wall panel 545 being installed. The third closed wall panel 545 includes at least one ratcheting take-up device 820 attached to the top of the bottom plate 540. A fourth tie rod 140 runs down the third closed wall panel 545 through an opening in the top plate 550. FIG. 7 also shows a third coupler nut 630 attached to the first end 142 of the fourth tie rod 140. The coupler nut 630 may be attached to the first end 142 by any means such as welding or engaged threads. The second end 144 of the fourth tie rod 140 extends through the top plate 550.

Figure 8:
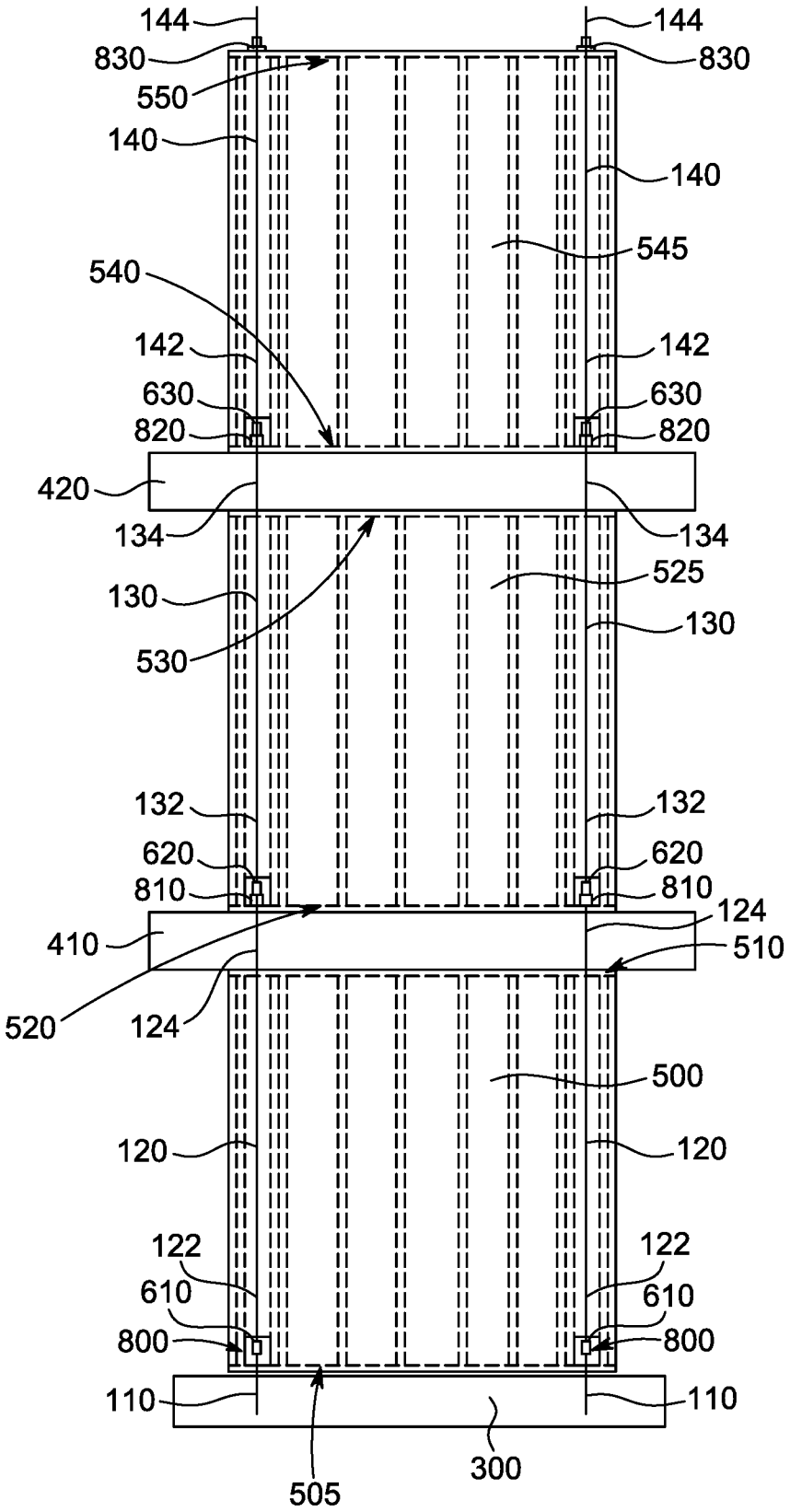
FIG. 8 is a front view of the third closed wall panel installed.

FIG. 8 is a front view of the third closed wall panel 545 installed. As shown in FIG. 8, the second end 134 of the third tie rod 130 extends up through the bottom plate 540 of the third closed wall panel 545 and through the second ratcheting take-up device 820. The second ratcheting take-up device 820 secures the third tie rod 130 in tension, thereby holding down the second floor plate 420 and second closed wall panel 525. The coupler nut 630 attaches to the second end 134 of the third tie rod 130. The coupler nut 630 may be attached to the third tie rod 130 by any means of attachment such as screwing the threaded coupler nut 630 onto the third tie rod 130. The second end 144 of the fourth tie rod 140 extends up through the top plate 550 of the third closed wall panel 545. A third ratcheting take-up device 830 is installed over the second end 144 of the fourth tie rod 140, thereby securing the fourth tie rod 140 in tension and holding down the third closed wall panel 545.

Figure 9:
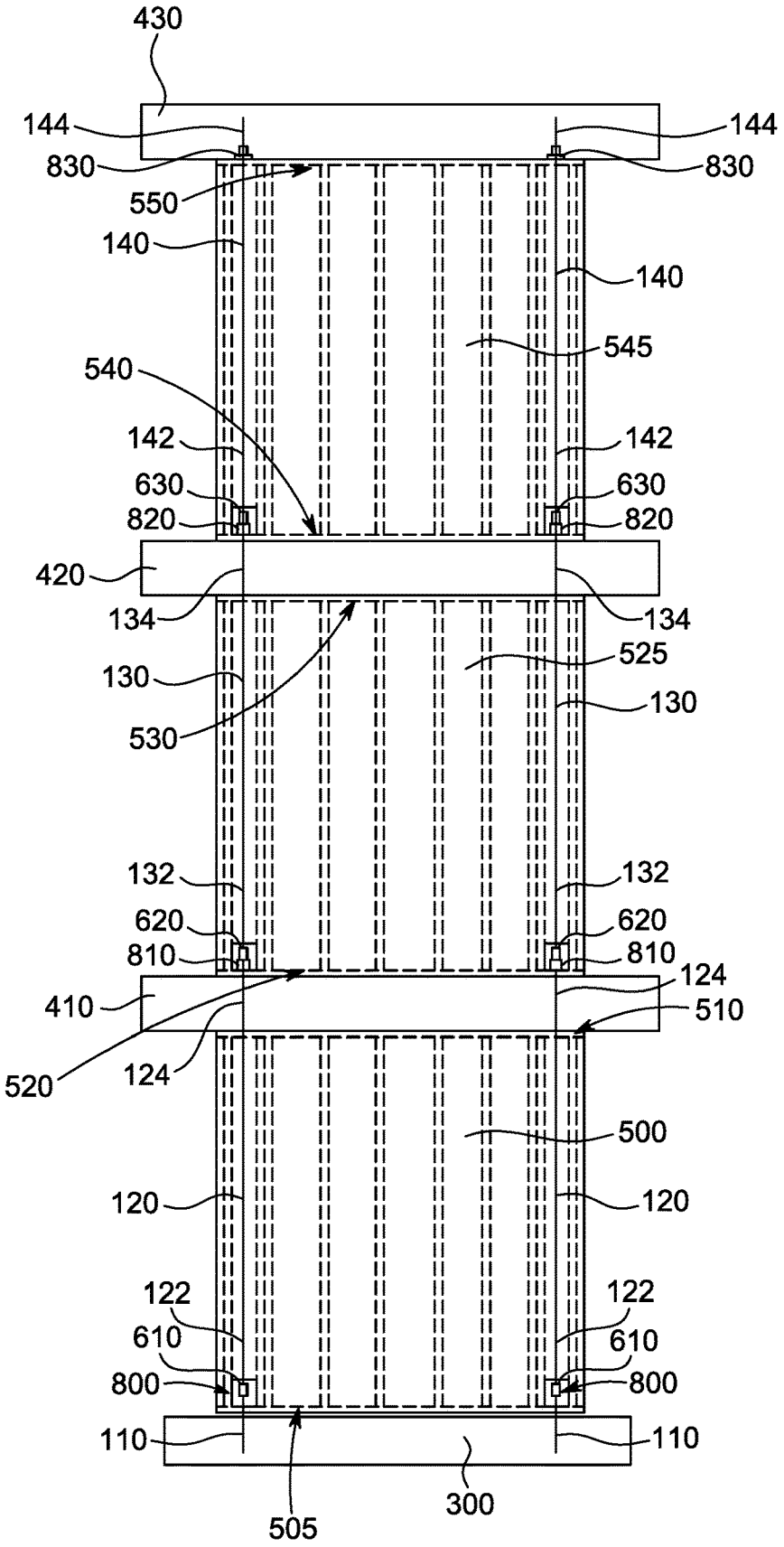
FIG. 9 is a front view of the wall system.

FIG. 9 is a front view of the wall system. FIG. 9 shows a third floor plate 430 installed on the top plate 550 of the third closed wall panel 545. The third floor plate 430 slides down over the second end 144 of the fourth tie rod 140 and is secured to the top plate 550. The third floor plate 430 may include predrilled holes at the locations of the fourth tie rods 140 and the third ratcheting take-up devices 830. Although FIGS. 1-9 depict a closed wall hold down system 100 for a three story wall, additional stories or floors may be installed in similar fashion.

Figure 10:
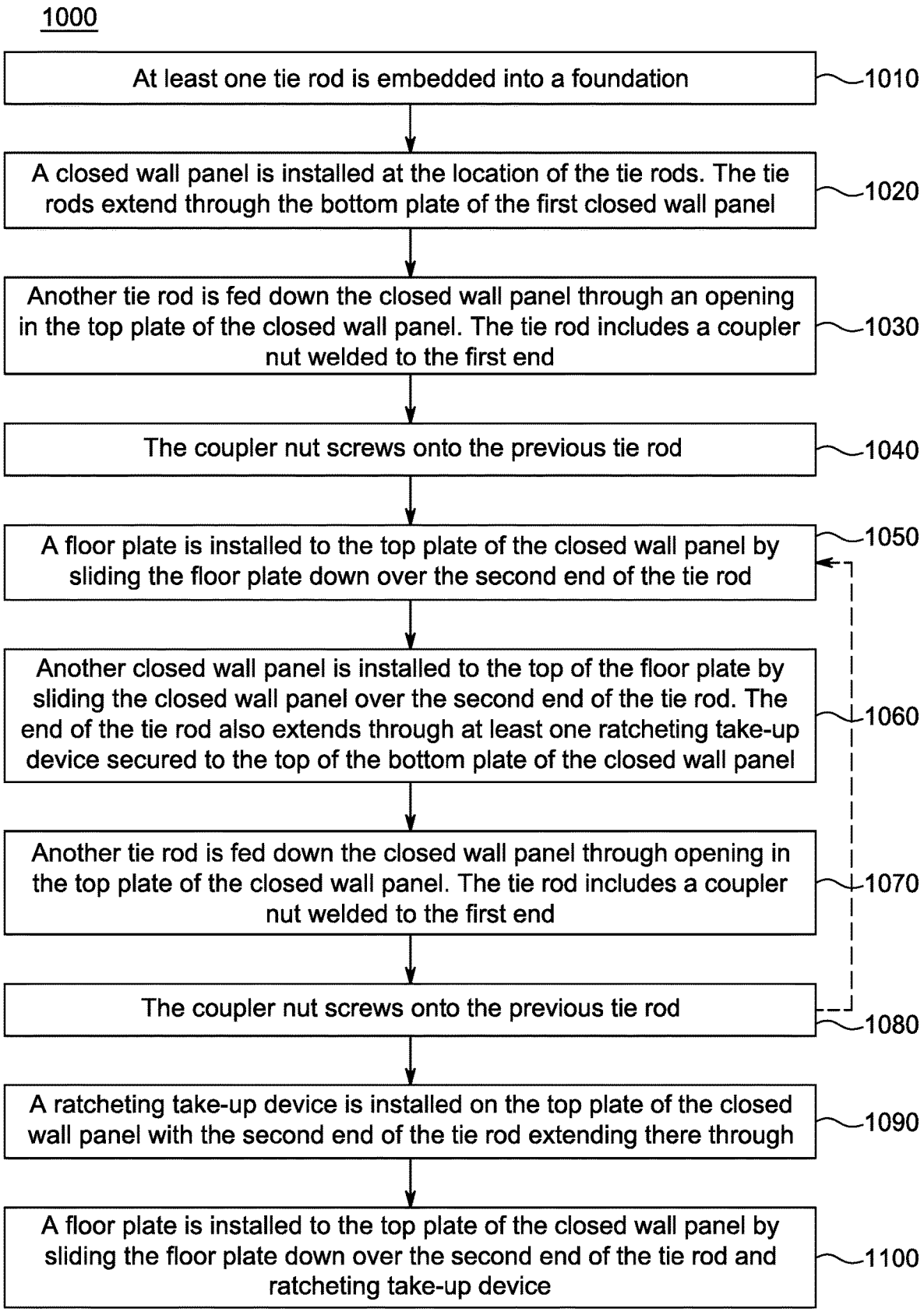
FIG. 10 is a flow chart of a method of installing the closed wall hold down system.

The method of installing the closed wall hold down system 1000 can be carried out according to the method 1000 described in FIG. 10 and described below. FIG. 10 is a flow chart of a method of installing the closed wall hold down system 1000. The method may include the step 1010 of installing a first tie rod 110 into a foundation 300. The tie rod 110 may be embedded by embedding the tie rod 110 in the foundation. The tie rod 110 acts as an anchor bolt. The first tie rod 110 includes the same details and embodiments of a first tie rod 110 previously discussed.

The method 1000 includes the step 1020 of installing a closed wall panel 500 at the location of the tie rods 110. A closed wall panel 500 is installed at the location of the tie rods 110 by sliding the closed wall panel 500 over the tie rods 110 with the tie rods 110 extending through openings in the bottom plate 505 of the closed wall panel 500. The closed wall panel 500 includes the details and embodiments of a closed wall panel 500 previously discussed.

The method 1000 includes the step 1030 of installing a second tie rod 120. The second tie rod 120 is installed by inserting the second tie rod 120 down the inside of the closed wall panel 500 through an opening in the top plate 510 of the wall panel 500. The tie rod 120 includes a coupler nut 610 welded or threaded onto the first end 122 of the tie rod 120. The coupler nut 610 is screwed onto the embedded tie rod 110. The second tie rod 120 includes the same details and embodiments of a second tie rod 120 previously discussed.

The method 1000 includes the step 1040 of connecting the coupler nut 610 of the second tie rod 120 to the embedded tie rod 110. The coupler nut 610 is connected to the embedded tie rod 110 by screwing the coupler nut 610 onto the end of the embedded tie rod 110. Threads on the inner circumference of the coupler nut 610 engage with threads on the end of the tie rod 110. The coupler nut 610 includes the same details and embodiments of a coupler nut 610 previously discussed.

The method 1000 includes the step 1050 of installing a floor plate 410. The floor plate 410 is installed on the top plate 510 of the closed wall panel 500 by sliding the floor plate 410 down over the second end 124 of the tie rod 120. The second end 124 of the tie rod 120 extends up through the floor plate 410. The floor plate 410 includes the same details and embodiments of a floor plate 410 previously discussed.

The method 1000 includes the step 1060 of installing a second closed wall panel 525 onto the floor plate 410. The second closed wall panel 525 is installed by sliding the closed wall panel 525 over the second end 124 of the tie rod 120. The second closed wall panel 525 includes the same details and embodiments of a second closed wall panel 525 previously discussed. The second end 124 of the tie rod 120 extends up through openings in the bottom plate 520 of the second closed wall panel 525. The second end 124 of the tie rod extends up through a ratcheting take-up device 810 secured to a top surface of the bottom plate 520. The ratcheting take-up device 810 includes the same details and embodiments of a ratcheting take-up device 810 previously discussed.

The method 1000 includes the step 1070 of installing a third tie rod 130. The third tie rod 130 is installed by inserting the third tie rod 130 down the inside of the second closed wall panel 525 through an opening in the top plate 530 of the wall panel 500. The tie rod 130 includes a coupler nut 620 welded or threaded onto the first end 122 of the tie rod 120. The coupler nut 620 is screwed onto the second tie rod 120. The third tie rod 130 includes the same details and embodiments of a third tie rod 130 previously discussed.

The method 1000 includes the step 1080 of connecting the coupler nut 620 of the third tie rod 130 to the second tie rod 120. The coupler nut 620 is connected to the second tie rod 120 by screwing the coupler nut 620 onto the end of the second tie rod 120. Threads on the inner circumference of the coupler nut 620 engage with threads on the end of the tie rod 120. The coupler nut 620 includes the same details and embodiments of a coupler nut 620 previously discussed.

If a building with more floors is desired, each additional floor and corresponding closed wall hold down system 100 may be installed according to steps 1050-1080.

After the final wall panel 545 is installed, the method 1000 includes the step 1090 of installing a ratcheting take-up device 830. The upper most wall panel 545 is secured to the previous wall panels 500, 525 by installing a ratcheting take-up device 830 on the top plate 550 of the upper most closed wall panel 545 with the second end 144 of the upper most tie rod 140 extending there through.

The method 1000 also includes the step 1100 of installing the final floor plate 430. The floor plate 430 is installed to the top plate 550 of the closed wall panel 545 by sliding the floor plate 430 down over the second end 144 of the tie rod 140 and ratcheting take-up device 830.

Having thus described in detail a preferred selection of embodiments of the present invention, it is to be appreciated and will be apparent to those skilled in the art that many physical changes could be made to the closed wall hold down system 100 without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A closed wall hold down system comprising:

at least one closed wall panel including a bottom plate and a top plate;

at least one first tie rod configured to project through the bottom plate within the at least one closed wall panel;

at least one coupler nut configured to couple the at least one first tie rod and a first end of an at least one second tie rod, a second end of the at least one second tie rod configured to extend through the top plate; and at least one ratcheting take-up device configured to engage with the second end of the at least one second tie rod;

wherein the at least one closed wall panel further includes at least one drywall blockout where the at least one coupler nut couples to the at least one first tie rod.

2. The closed wall hold down system of claim 1 wherein the at least one closed wall panel further includes at least one second ratcheting take-up device coupled to a surface of the bottom plate.

3. The closed wall hold down system of claim 1 further including a floor plate installed on the top plate.

4. The closed wall hold down system of claim 3 wherein at least one of the floor plate, the top plate, and the bottom plate include a funnel and a pipe to serve as a guide.

5. The closed wall hold down system of claim 1 wherein the at least one coupler nut includes physical markings to determine a degree of rotation of the coupler nut.

6. The closed wall hold down system of claim 1 wherein the at least one coupler nut is welded to the at least one second tie rod.

7. A method of installing a closed wall hold down system comprising:

installing a closed wall panel including a drywall blockout, a bottom plate and a top plate over at least one first tie rod, the at least one first tie rod projecting through the bottom plate;

running at least one second tie rod down through the top plate, the at least one second tie rod including a first end, a second end, and a coupler nut coupled to the first end, the second end extending through the top plate;

threading the coupler nut onto the at least one first tie rod at the location of the drywall blockout; and installing at least one ratcheting take-up device onto the second end.

8. The method of claim 7 further comprising installing a floor plate onto the top plate.

9. The method of claim 8 further comprising installing a second closed wall panel including a second bottom plate and a second top plate onto the floor plate.

10. The method of claim 9 further comprising running at least one third tie rod down through the second top plate, the at least one third tie rod including a third end, a fourth end, and a second coupler nut coupled to the third end, the fourth end extending through the second top plate.

11. The method of claim 10 further comprising threading the second coupler nut onto the second end of the at least one second tie rod.

12. The method of claim 11 further comprising installing a second floor plate onto the second top plate.

13. The method of claim 12 further comprising installing a third closed wall panel including a third bottom plate, a third top plate, and at least one second ratcheting take-up device coupled to the third bottom plate onto the second floor plate, wherein the fourth end of the at least one second tie rod extends through the at least one second ratcheting take-up device.

14. The method of claim 13 further comprising running at least one third tie rod down through the third top plate, the at least one third tie rod including a fifth end, a sixth end, and a third coupler nut coupled to the fifth end, the sixth end extending through the third top plate.

15. The method of claim 14 further comprising threading the third coupler nut onto the fourth end of the at least one second tie rod.

16. The method of claim 15 further comprising installing at least one third ratcheting take-up device onto the sixth end.

17. The method claim 16 further comprising installing a third floor plate onto the third top plate.

18. A method of installing a closed wall hold down system comprising:

installing a first closed wall panel including a first drywall blockout, a first bottom plate and a first top plate over at least one first tie rod, the at least one first tie rod projecting through the first bottom plate;

running at least one second tie rod down through the first top plate, the at least one second tie rod including a first end, a second end, and a first coupler nut coupled to the first end, the second end extending through the first top plate;

threading the first coupler nut onto the at least one first tie rod at the location of the first drywall blockout;

placing a floor plate over the second end of the at least one second tie rod and onto the first top plate;

installing a second closed wall panel including a second drywall blockout, a second bottom plate having at least one first ratcheting take-up device attached to a surface of the second bottom plate and a second top plate onto the floor plate with the second end of the at least one second tie rod extending through the at least one first ratcheting take-up device;

running at least one third tie rod down through the second top plate, the at least one third tie rod including a third end, and a fourth end, and a second coupler nut coupled to the third end, the fourth end extending through the second top plate;

threading the second coupler nut onto the at least one second tie rod at the location of the second drywall blockout; and installing at least one second ratcheting take-up device with the fourth end of the at least one third tie rod extending there through.

19. A closed wall hold down system comprising:

at least one closed wall panel including a bottom plate and a top plate;

at least one first tie rod configured to project through the bottom plate within the at least one closed wall panel;

at least one coupler nut including photo-emissive markings to determine a degree of rotation of the at least one coupler nut, the at least one coupler nut configured to couple the at least one first tie rod and a first end of an at least one second tie rod, a second end of the at least one second tie rod configured to extend through the top plate; and at least one ratcheting take-up device configured to engage with the second end of the at least one second tie rod.

20. A method of installing a closed wall hold down system comprising:

installing a closed wall panel including a bottom plate and a top plate over at least one first tie rod, the at least one first tie rod projecting through the bottom plate;

running at least one second tie rod down through the top plate, the at least one second tie rod including a first end, a second end, and a coupler nut coupled to the first end, the second end extending through the top plate;

threading the coupler nut onto the at least one first tie rod, the coupler nut includes photo-emissive markings to determine a degree of rotation of the coupler nut; and installing at least one ratcheting take-up device onto the second end.

21. A method of installing a closed wall hold down system comprising:

installing a first closed wall panel including a first bottom plate and a first top plate over at least one first tie rod, the at least one first tie rod projecting through the first bottom plate;

running at least one second tie rod down through the first top plate, the at least one second tie rod including a first end, a second end, and a first coupler nut coupled to the first end, the second end extending through the first top plate;

threading the first coupler nut onto the at least one first tie rod, the first coupler nut includes photo-emissive markings to determine a degree of rotation of the first coupler nut;

placing a floor plate over the second end of the at least one second tie rod and onto the first top plate;

installing a second closed wall panel including a second bottom plate having at least one first ratcheting take-up device attached to a surface of the second bottom plate and a second top plate onto the floor plate with the second end of the at least one second tie rod extending through the at least one first ratcheting take-up device;

running at least one third tie rod down through the second top plate, the at least one third tie rod including a third end, and a fourth end, and a second coupler nut coupled to the third end, the fourth end extending through the second top plate;

threading the second coupler nut onto the at least one second tie rod, the second coupler nut includes photo-emissive markings to determine a degree of rotation of the second coupler nut; and installing at least one second ratcheting take-up device with the fourth end of the at least one third tie rod extending there through.

* * * * *